US009033737B2

(12) United States Patent
Chang et al.

(10) Patent No.: US 9,033,737 B2
(45) Date of Patent: May 19, 2015

(54) ELECTRICAL CONNECTOR

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/093,539

(22) Filed: Dec. 2, 2013

(65) Prior Publication Data

US 2015/0056857 A1 Feb. 26, 2015

(30) Foreign Application Priority Data

Aug. 23, 2013 (TW) ..... 102215789 U

(51) Int. Cl.
*H01R 9/03* (2006.01)
*H01R 13/6588* (2011.01)

(52) U.S. Cl.
CPC ..... *H01R 13/6588* (2013.01)

(58) Field of Classification Search
CPC ..... H01R 23/688; H01R 4/643
USPC ..... 439/607.05, 607.06, 607.07, 607.08, 439/607.09, 101, 108, 907.1, 907.11, 439/607.13
See application file for complete search history.

(56) References Cited

U.S. PATENT DOCUMENTS

| | | | | |
|---|---|---|---|---|
| 8,814,603 | B2 * | 8/2014 | Chang et al. | 439/626 |
| 8,851,904 | B2 * | 10/2014 | Chang et al. | 439/71 |
| 2009/0221165 | A1 * | 9/2009 | Buck et al. | 439/108 |
| 2012/0196479 | A1 * | 8/2012 | Chow et al. | 439/607.35 |
| 2014/0038438 | A1 * | 2/2014 | Chang et al. | 439/76.1 |
| 2014/0038465 | A1 * | 2/2014 | Chang et al. | 439/626 |

FOREIGN PATENT DOCUMENTS

TW 419248 M 12/2011

* cited by examiner

*Primary Examiner* — Phuongchi T Nguyen
(74) *Attorney, Agent, or Firm* — Wei Te Chung; Ming Chieh Chang

(57) ABSTRACT

An electrical connector electrically connecting a chip module to a printed circuit board, includes an insulative housing comprising a top surface, a bottom surface opposite to the top surface and a plurality of passageways penetrated from the top surface to the bottom surface, a number of terminals received in the passageways and a number of shielding plates received in the passageways, the terminals includes a number of grounding terminals and a number of signal terminals, the shielding plates located beside the terminals respectively, the insulative housing includes a number of tubers with strip shape protruding from the top surface, upper surface of the tubers are plated with a metal layer and the shielding plate electrically contacts with the metal layer, as well, the grounding terminal electrically contacts with the metal layer.

19 Claims, 7 Drawing Sheets

ELECTRICAL CONNECTOR

BACKGROUND OF THE INVENTION

1. Field of the Invention

The present invention relates to an electrical connector, and more particularly to an electrical connector has a metal layer plated on a top surface of an insulative housing to contact with both of a shielding plate and a grounding terminal for improving the shielding effect.

2. Description of the Related Art

An electrical connector electrically connecting a chip module to a printed circuit board is described in Tai Wan Patent No. M419248, issued to CHANG on Dec. 21, 2011. The electrical connector includes a socket body with a plurality of terminals secured therein. The socket body has a top surface, a lower surface opposite to the top surface and a number of grooves penetrate from the top surface to the lower surface. Each of the grooves includes a first groove and a second groove. The electrical connector further includes a metal shielding plate assembled in the second groove. The terminal includes a base portion, an upper spring beam extending upwardly from the base portion, a lower spring beam extending downwardly from the base portion and a retention portion bending outwardly from a side of the base portion. The upper spring beam has a contacting portion bending upwardly and the lower spring beam has a soldering portion bending downwardly. The base portion, the retention portion, the upper spring beam and the lower spring beam received in the first groove. Due to the shielding plate neither contacts with the chip module nor the printed circuit board, and the contacting portion and the soldering portion are exposed at the exterior of the insulative housing, thus the shielding plate can not shield the whole terminal. So, it affects the quality of the signal transmission.

Therefore, it is needed to find a new electrical socket to overcome the problems mentioned above.

SUMMARY OF THE INVENTION

Accordingly, an object of the present invention is to provide an electrical connector getting better shielding effect.

In order to achieve the object set forth, an electrical connector electrically connecting a chip module to a printed circuit board, comprises an insulative housing comprising a top surface, a bottom surface opposite to the top surface and a plurality of passageways penetrated from the top surface to the bottom surface, a plurality of terminals received in the passageways and a plurality of shielding plates received in the passageways, the terminals comprises a plurality of grounding terminals and a plurality of signal terminals, the shielding plates located beside the terminals respectively, the insulative housing comprises a plurality of tubers with strip shape protruding from the top surface, upper surface of the tubers are plated with a metal layer and the shielding plate electrically contacts with the metal layer, as well, the grounding terminal electrically contacts with the metal layer.

DESCRIPTION OF PREFERRED EMBODIMENT

Reference will now be made to the drawings to describe the present invention in detail.

Figure 1:
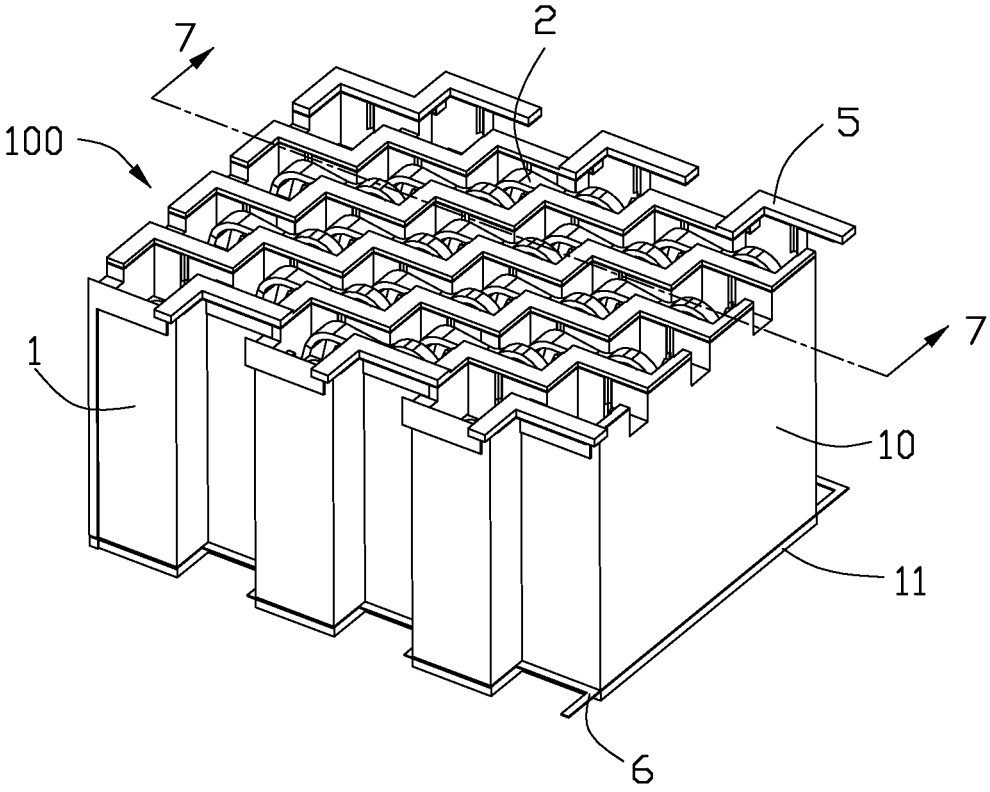
FIG. 1 is an assembled view of an electrical connector in accordance with a preferred embodiment of the present invention.
Figure 2:
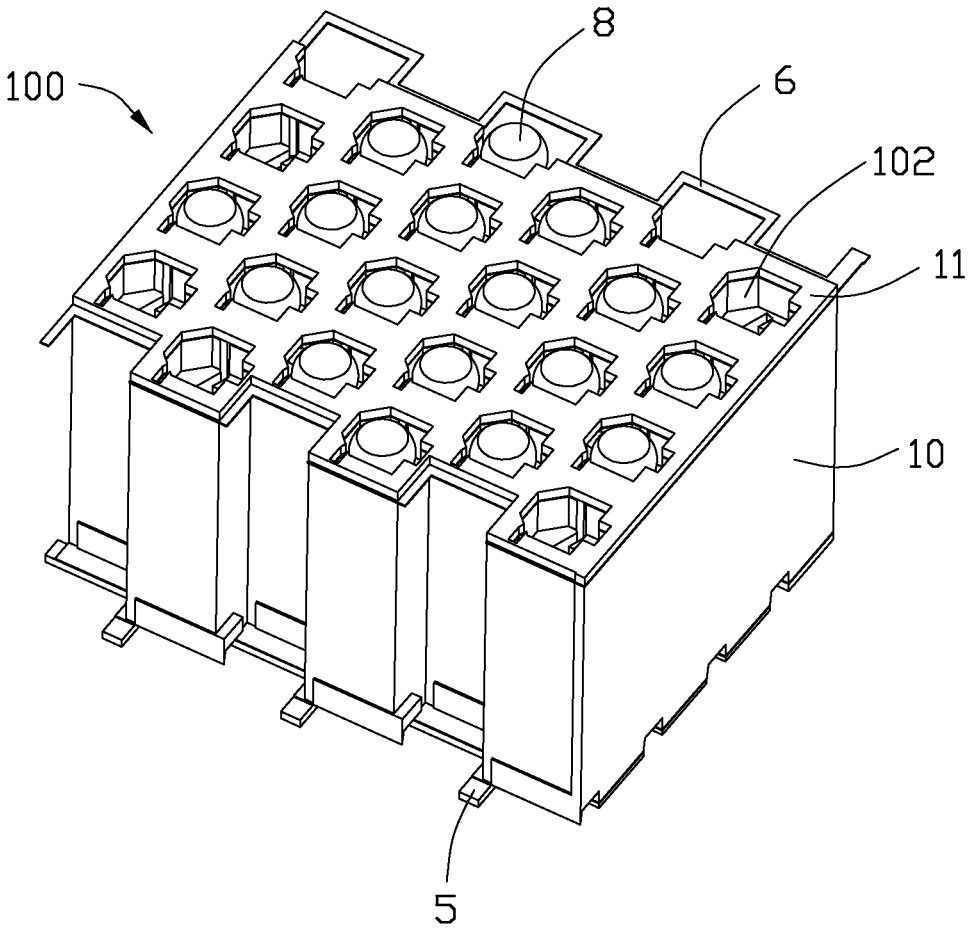
FIG. 2 is another assembled view of the electrical connector as shown in FIG. 1.
Figure 3:
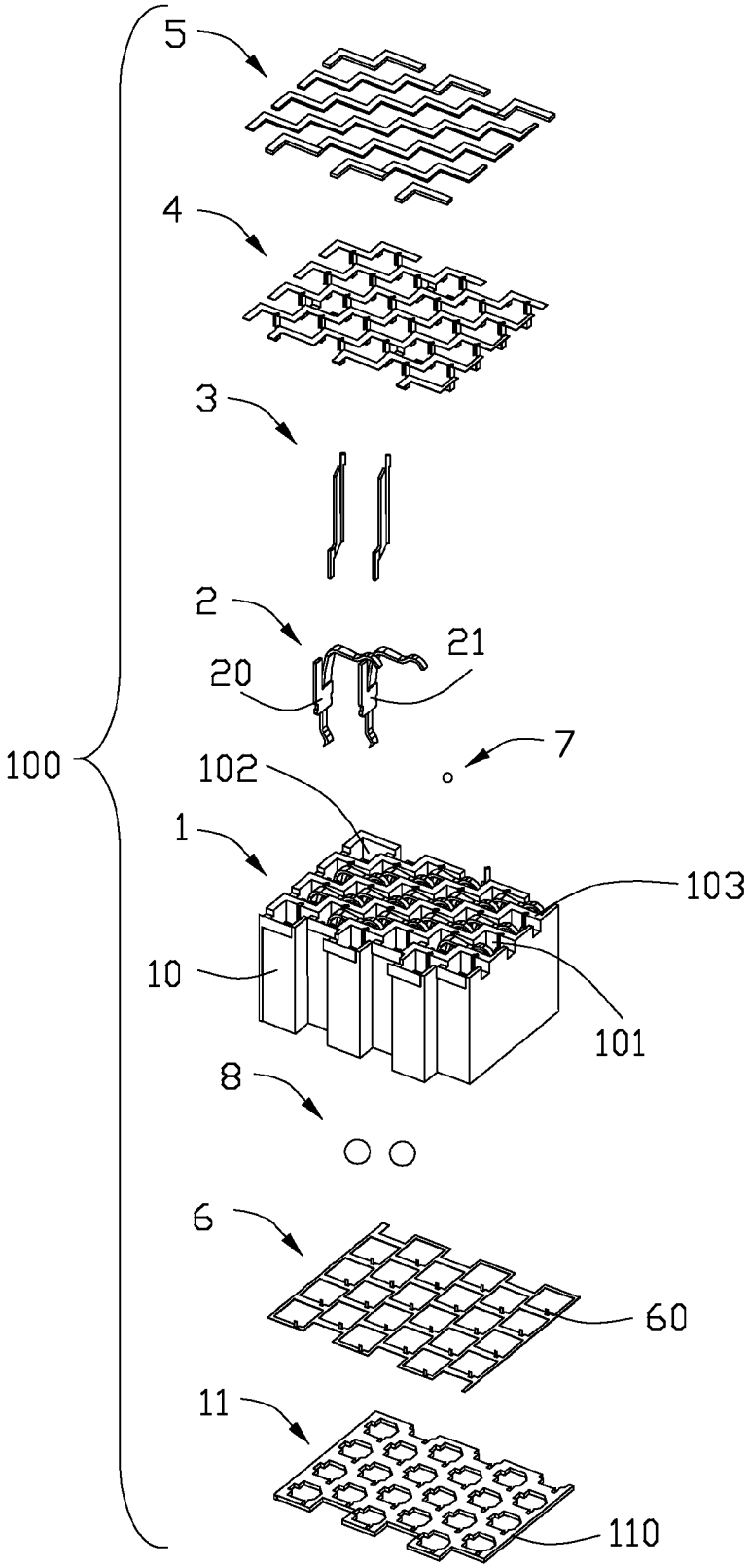
FIG. 3 is an exploded view of the electrical connector as shown in FIG. 1.

Referring to FIGS. 1-3, an electrical connector 100 according to the present invention is used to electrically connecting a chip module (not show) to a printed circuit board (not show) and comprises an insulative housing 1 with a plurality of terminals 2 received therein, a plurality of shielding plates 3 received therein and a plurality of solder balls 8 soldered the terminals 2 to the printed circuit board. The shielding plate 3 is located at a side of the terminal 2.

Referring to FIGS. 2-5, the insulative housing 1 comprises a top surface 101, a bottom surface 110 and a plurality of passageways 102 penetrated from the top surface 101 to the bottom surface 110. The insulative housing 1 further comprises a plurality of tubers 103 and a plurality of supporting portions 104 protruding from the top surface 101 respectively, the supporting portion 104 locates close to the tubers 103 and the supporting portion 104 has a dimple 105 depressed from the top of the supporting portion 104. The tuber 103 is higher than the supporting portion 104 and they are configured with a ladder shape. The tubers 103 stretch along a horizontal direction and then stretch along a longitudinal direction that perpendicular to a vertical direction the tubers 103 protruding. The tubers 103 are configured with a zigzag shape, the supporting portions 104 locate at one side of the tubers 103 and locate at the corner of the tubers 103. The supporting portion 104 locates beside the terminal 2.

The electrical connector 100 further comprises a shielding layer 6 insert molded at lower end of the insulative housing 1. The insulative housing 1 is divided into a top insulative housing 10 and a bottom insulative housing/layer 11 by the shielding layer 6 and the shielding layer 6 locates between the top insulative housing 10 and the bottom insulative housing 11. The top insulative housing 10 is integrated with the bottom insulative housing 11. The shielding layer 6 has a plurality of resisting portions 60 at the rim of the passageways 102, the resisting portion 60 is exposed to the passageway 102 when the shielding plates 3 are assembled into the insulative housing 1 from bottom to top and it pushes the shielding layer 6 to form the resisting portions 60 by bending then make the resisting portions 60 locate in the passageway 102, and the shielding plate 3 electrically connects with the resisting portion 60.

Figure 4:
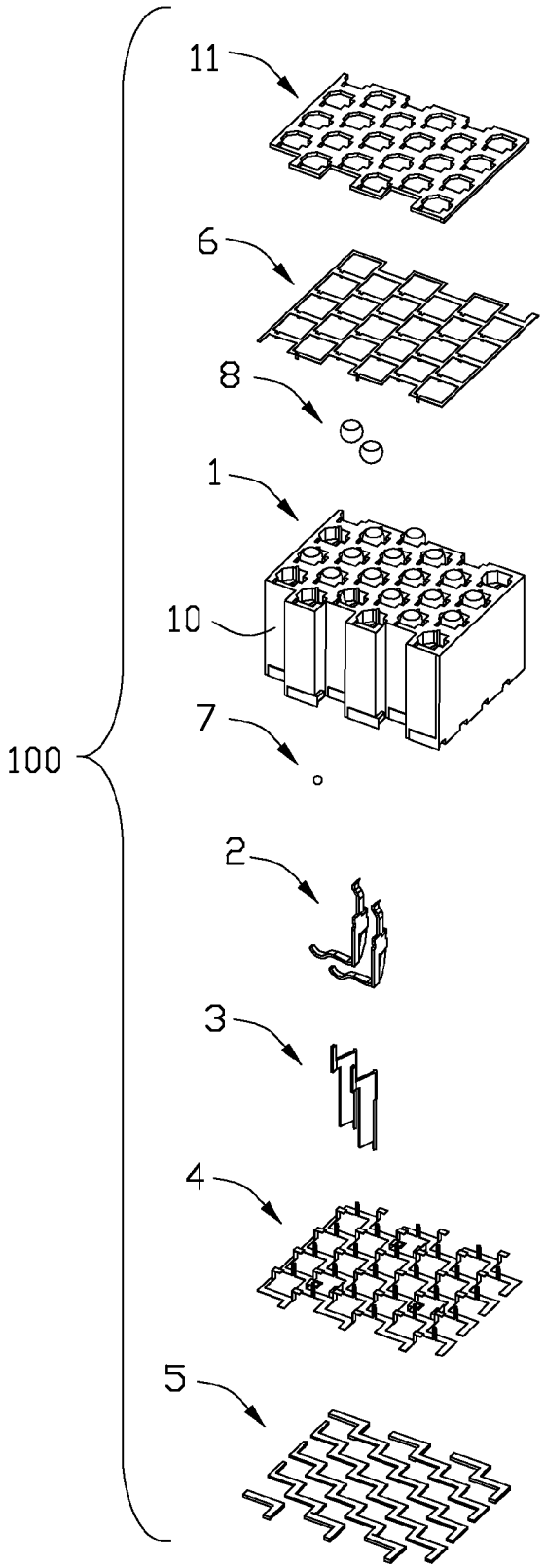
FIG. 4 is an another exploded view of the electrical connector as shown in FIG. 3.
Figure 5:
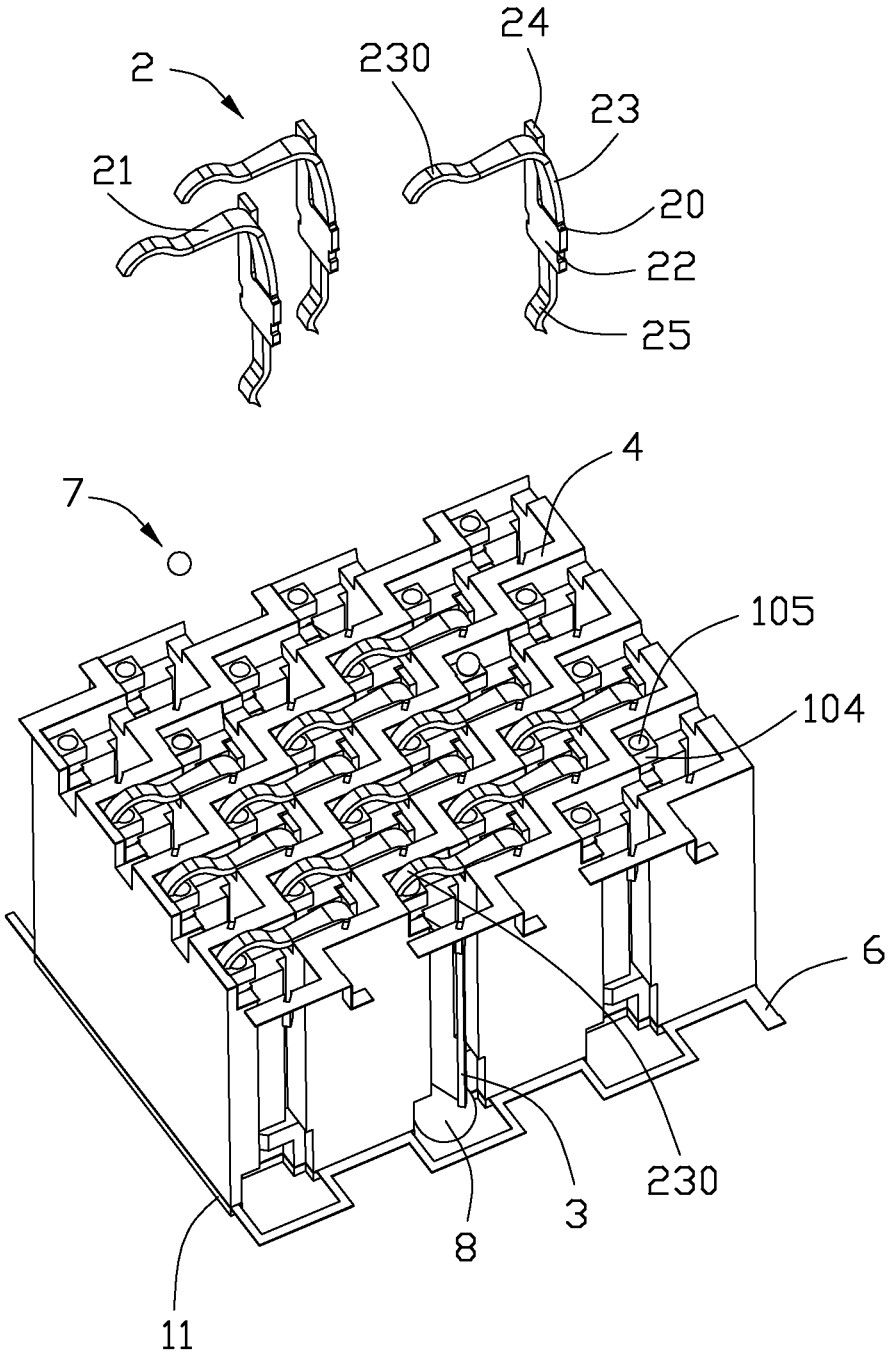
FIG. 5 is a partly exploded view of the electrical connector as shown in FIG. 3.

Referring to FIGS. 3-5, the terminals 2 comprise a plurality of grounding terminals 21 and a plurality of signal terminals 20 mounted in the passageways 102 adjacent to the grounding terminals 21. The structure of the signal terminal 20 is same with the structure of the grounding terminal 21. The terminal 2 comprises a base 22, a spring beam 23 bending upwardly from one side of the base 22, an extending portion 24 extending upwardly from another side of the base 22 and a soldering portion 25 bending downwardly from the base 22. An end of the spring beam 23 has a contacting portion 230 for contacting with the chip module.

Figure 6:
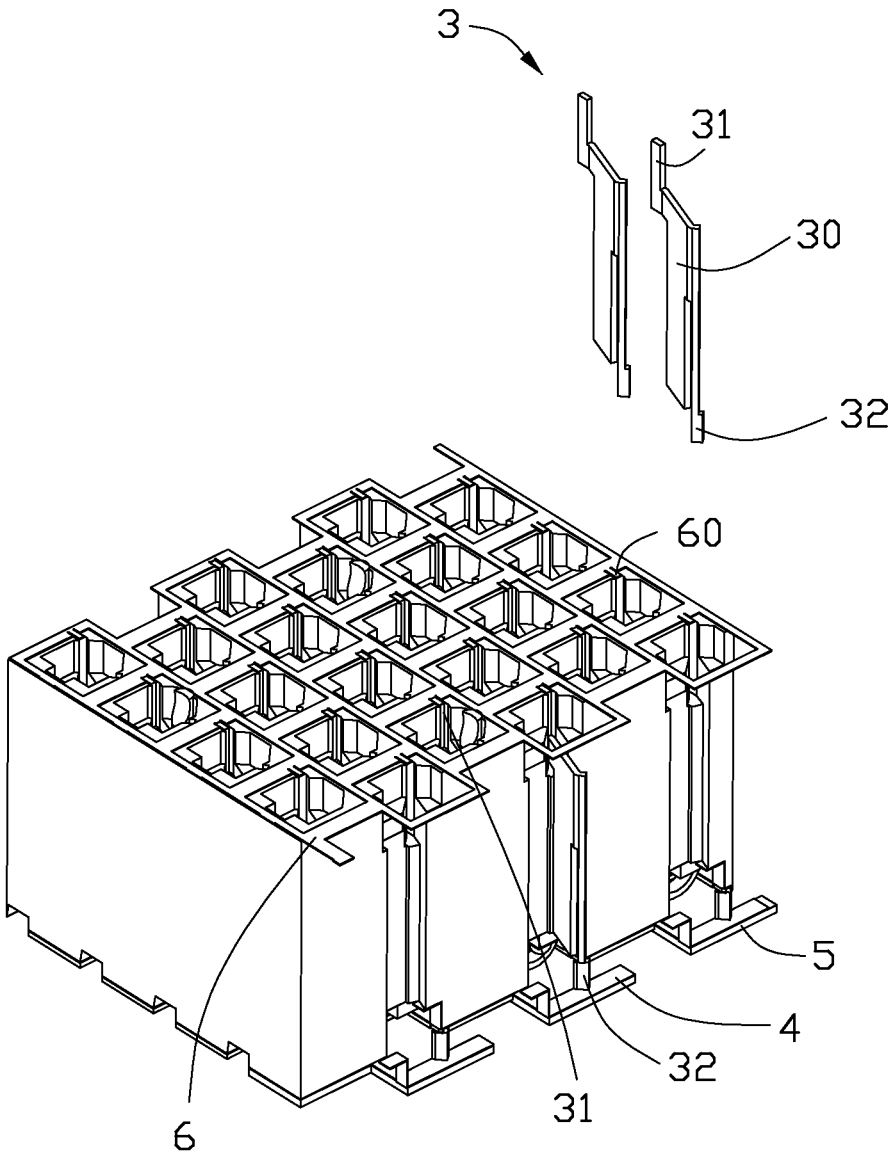
FIG. 6 is another partly exploded view of the electrical connector as shown in FIG. 3.
Figure 7:
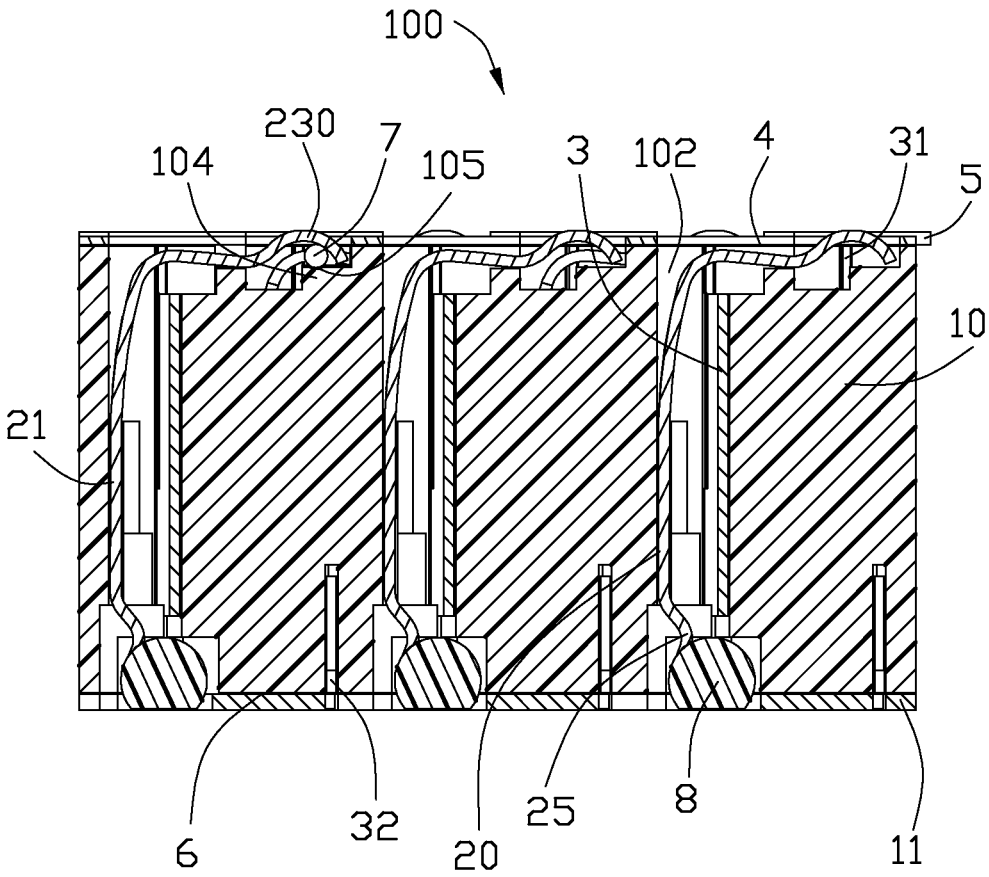
FIG. 7 is a cross-sectional view of the electrical connector taken along line as shown 7-7 in FIG. 1.

Referring to FIGS. 3 and 6, the shielding plate 3 comprises a body portion 30, a top connecting portion 31 extending upwardly from the body portion 30 and a bottom connecting portion 32 extending downwardly from the body portion 30. The upper surface (not labeled) of the tuber 103 is plated with a metal layer 4 configured with a zigzag shape corresponding to the tuber 103. The top connecting portion 31 interferes with the metal layer 4 and electrically connects with the metal layer 4. The electrical connector 100 further comprises an insulating layer 5 configured with a zigzag shape corresponding to the tubers 103 is assembled on the metal layer 4 for preventing the shorting of the metal layer 4 and the chip module.

The electrical connector 100 further comprises a plurality of connecting elements 7 connecting the grounding terminal 21 and the metal layer 4. The connecting element 7 locates at the dimple 105 and the dimple 105 is plated with the metal layer 4. The grounding terminal 21 electrically connects with the connecting element 7 after being pressed by the chip module.

The resisting portion 60 is pushed into the passageway 102 when assembling the shielding plate 3 into the insulative housing 1 in a vertical direction perpendicular to the horizontal direction and then the shielding plate 3 electrically connects the resisting portion 60 of the shielding layer 6. The shielding plate 3 locates beside the terminal 2 electrically connects the metal layer 4 located on top surface of the insulative housing and the shielding layer 6 located at lower end of the insulative housing 1. So, the terminals 2 are shielded both in upper end by the metal layer 4, lower end by the shielding layer 6 and the periphery thereof by the shielding plate 3 and it can get a better shielding effect.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector electrically connecting a chip module to a printed circuit board, comprising:

an insulative housing comprising a top surface, a bottom surface opposite to the top surface and a plurality of passageways penetrated from the top surface to the bottom surface;

a plurality of terminals received in the passageways, comprising a plurality of grounding terminals and a plurality of signal terminals; and wherein a plurality of shielding plates received in the passageways and located beside the terminals respectively; wherein the insulative housing comprises a plurality of tubers with a plurality of strip shapes protruding from the top surface, upper surfaces of the tubers are plated with a metal layer, the metal layer electrically constantly contacts with shielding plate, and further the grounding terminal when the grounding terminal is pressed by the chip module.

2. The electrical connector as claimed in claim 1, wherein said tubers stretch along a horizontal direction and then stretch along a longitudinal direction that perpendicular to a vertical direction that the tubers protruding and the tubers are configured with zigzag shape.

3. The electrical connector as claimed in claim 1, wherein said shielding plate comprises a body portion, a top connecting portion extending upwardly from the body portion and a bottom connecting portion extending downwardly from the body portion, the top connecting portion interferes with the metal layer and electrically contacts with the metal layer.

4. The electrical connector as claimed in claim 1, wherein said electrical connector further comprises a plurality of insulating layers assembled on upper surface of the tubers for preventing the short out of the metal layer and the chip module.

5. The electrical connector as claimed in claim 1, wherein the adjacent tubers are spaced out by the terminals, the tubers stretch along a horizontal direction and then stretch along a longitudinal direction perpendicular to a vertical direction that the tubers protruding, the terminals are located between the adjacent tubers.

6. The electrical connector as claimed in claim 5, wherein said shielding layer has a plurality of resisting portions at the rim of the passageways and the resisting portion is exposed to the passageway and the shielding plate is assembled into the insulative housing from bottom to top, the resisting portion is formed by pushing and bending the shielding layer during the shielding plate being assembled into the insulative housing and the shielding plate electrically contacts with the resisting portion of the shielding layer.

7. The electrical connector as claimed in claim 1, wherein said electrical connector further comprises a plurality of connecting elements assembled to the insulative housing and electrically connected with the grounding terminals and the metal layer.

8. The electrical connector as claimed in claim 7, wherein said insulative housing further comprises a plurality of supporting portions located next to the tubers and the supporting portions locate at one side of the tubers and locate at the corner of the tubers, the supporting portion has a dimple plated with the metal layer, the connecting element is located at the dimple and electrically contacted with the metal layer.

9. The electrical connector as claimed in claim 8, wherein the tuber is higher than the supporting portion and they are configured with a ladder shape.

10. The electrical connector as claimed in claim 1, wherein said electrical connector further comprises a shielding layer insert molded with the insulative housing and located at lower end of the insulative housing.

11. The electrical connector as claimed in claim 10, wherein said insulative housing is divided into two pieces by the shielding layer and the insulative housing comprises a top insulative housing and a bottom insualtive housing, the shielding layer locates between the top insulative housing and the bottom insulative housing and the top insulative housing are integrated with the bottom insulative housing.

12. The electrical connector as claimed in claim 10, wherein said shielding layer has a plurality of resisting portions at the rim of the passageways and the resisting portion is exposed to the passageway.

13. The electrical connector as claimed in claim 12, wherein said resisting portion is formed by pushing and bending the shielding layer during the shielding plate being assembled into the insulative housing and the shielding plate electrically contacts with the resisting portion of the shielding layer.

14. An electrical connector comprising:

an insulative housing defining opposite top and bottom surfaces in a vertical direction;

a plurality of passageways extending through said housing in said vertical direction;

a plurality of terminals disposed in the corresponding passageways, respectively, each of said terminals defining an upper deflectable contacting section and a lower soldering section, said terminals including grounding terminals and signal terminals;

the insulative housing comprising a plurality of tubers with a plurality of strip shapes protruding from the top surface;

a top shielding layer applied upon upper surfaces of the tubers;

a bottom shielding layer applied upon the bottom surface of the housing;

a plurality of shielding plates disposed in the housing with opposite upper and lower ends respectively contacting the top shielding layer and the bottom shielding layer; wherein the top shielding layer further contacts the grounding terminals when the terminals are pressed.

15. The electrical connector as claimed in claim 14, further including opposite upper and lower insualtive layers respectively covering the upper shielding layer and the bottom shielding layer for preventing shorting.

16. The electrical connector as claimed in claim 14, wherein each of said shielding plates is received in the same passageway with the corresponding terminal in a lateral communicative manner.

17. An electrical connector for use with a chip module, comprising:

an insulative housing defining opposite top and bottom faces in a vertical direction;

a plurality of passageways extending through said housing in said vertical direction;

a plurality of terminals disposed in the corresponding passageways, respectively, each of said terminals defining an upper deflectable contacting section and a lower soldering section, said terminals including a plurality of signal terminals and a plurality of grounding terminals;

a top shielding layer applied upon the top face of the housing; and a plurality of shielding plates disposed in the housing with upper ends contacting the top shielding layer; wherein the top face of the housing defines a plurality of cutouts corresponding to the passageways, respectively, so as to allow downward deflection of the contacting sections of the corresponding terminals, respectively; wherein the top shielding layer defines a plurality of parallel zigzag like strips instead of a net structure; wherein the insulative housing comprising a plurality of tubers with strip shapes protruding from the top surface, and said top shielding layer is plated upon upper surfaces of said tubers and contacts the grounding terminals when said grounding terminals are pressed by the chip module.

18. The electrical connector as claimed in claim 17, wherein the passageways and the corresponding terminals are arranged in an offset manner between the neighboring arrays so as to have said zigzag like strips extend along a diagonal direction instead of either a longitudinal direction or a transverse direction perpendicular to said longitudinal direction, and said diagonal direction is angled to both said longitudinal direction and said transverse direction.

19. The electrical connector as claimed in claim 18, further including a bottom shielding layer applied upon the bottom face of the housing, wherein said shielding plates mechanically and electrically connect to said bottom shielding.

* * * * *